US009204226B2

(12) United States Patent
Sigwanz et al.

(10) Patent No.: US 9,204,226 B2
(45) Date of Patent: Dec. 1, 2015

(54) METHOD FOR ADJUSTING A HEARING DEVICE AS WELL AS AN ARRANGEMENT FOR ADJUSTING A HEARING DEVICE

(75) Inventors: Ullrich Sigwanz, Hombrechtikon (CH); Patrick Baechler, Gutenswil (CH); Philipp Schneider, Zurich (CH); Nicola Schmitt, Stafa (CH)

(73) Assignee: SONOVA AG, Staefa (CH)

( * ) Notice: Subject to any disclaimer, the term of this patent is extended or adjusted under 35 U.S.C. 154(b) by 243 days.

(21) Appl. No.: 13/820,794

(22) PCT Filed: Sep. 14, 2010

(86) PCT No.: PCT/EP2010/063434

§ 371 (c)(1),
(2), (4) Date: Mar. 5, 2013

(87) PCT Pub. No.: WO2010/146188

PCT Pub. Date: Dec. 23, 2010

(65) Prior Publication Data

US 2013/0170661 A1 Jul. 4, 2013

(51) Int. Cl.
*H04R 29/00* (2006.01)
*H04R 25/00* (2006.01)

(52) U.S. Cl.
CPC ..... *H04R 25/30* (2013.01); *H04R 25/70* (2013.01); *H04R 2225/43* (2013.01)

(58) Field of Classification Search
CPC ..... H04R 25/70; H04R 2225/43; H04R 25/30
USPC ..... 381/60, 314, 312, 104, 320, 321, 58
See application file for complete search history.

(56) References Cited

U.S. PATENT DOCUMENTS

| | | | | |
|---|---|---|---|---|
| 4,548,082 | A | 10/1985 | Ebgebretson et al. | |
| 5,729,658 | A | 3/1998 | Hou et al. | |
| 2006/0039576 | A1 | 2/2006 | Roithinger et al. | |
| 2006/0245610 | A1 | 11/2006 | Chalupper | |
| 2009/0046878 | A1 | 2/2009 | Sorgel et al. | |
| 2010/0202636 | A1 * | 8/2010 | Frohlich et al. | 381/314 |

FOREIGN PATENT DOCUMENTS

| | | | |
|---|---|---|---|
| JP | 2007-295324 | A | 11/2007 |
| WO | 2010-073614 | A1 | 7/2010 |

OTHER PUBLICATIONS

International Search Report for PCT/EP2010/063434 dated Jun. 20, 2011.
Written Opinion for PCT/EP2010/063434 dated Jun. 20, 2011.

* cited by examiner

*Primary Examiner* — Thjuan K Addy
(74) *Attorney, Agent, or Firm* — Pearne & Gordon LLP

(57) ABSTRACT

A method for adjusting a hearing device (1) to individual needs of a hearing device user includes the steps of operationally connecting the hearing device (1) to a fitting device (5) with a display unit (6), displaying a hearing threshold level (22) of the hearing device user as a function of frequencies on the display unit (6), displaying characteristics of a predefined sound sample (25, 30) on the display unit (6), and adjusting the input/output behavior such that at least a part of the predefined sound sample (25, 30) lies above the hearing threshold level (22) at corresponding frequencies. An arrangement for adjusting a hearing device (1) is also provided.

18 Claims, 1 Drawing Sheet

METHOD FOR ADJUSTING A HEARING DEVICE AS WELL AS AN ARRANGEMENT FOR ADJUSTING A HEARING DEVICE

TECHNICAL FIELD OF THE INVENTION

The present invention is related to a method for adjusting a hearing device as well as to an arrangement for adjusting a hearing device.

DESCRIPTION OF THE RELATED ART

An adjustment of a hearing device to the needs of a prospective user is usually based on a so called audiogram representing the hearing impairment. The audiogram is measured applying a standard procedure and forms the basis for calculating therapeutic pre-adjustments of the hearing device behavior. Due to different nature of hearing losses, the calculated pre-adjustments can mostly only be used for a starting point. Fine-tuning of the input/output behavior of the hearing device is necessary in most cases to obtain an acceptable operation behavior.

Generally, there are two types of adjustment programs that are used to adjust hearing devices to individual needs: First, a number of programs are available that allow the adjustments of single parameters of the input/output behavior of a hearing device. Second, so called assistant programs are used to lead an audiologist by a question/answer procedure to find out solutions in different surround situations that may be encountered by the hearing device user. For a certain sound situation, as e.g. speech in noise, the patient can provide subjective information as to how he perceives the loudness, the timbre and the naturalness of the presented sound. The information is though not sufficient for the audiologist to objectively survey, control and adjust the settings in the hearing device.

Furthermore, graphical interfaces for supporting an audiologist to adjust a hearing device are disclosed by US 2009/046878 A1, JP 2007-295324 A2 and by US-2006/039576 A1.

SUMMARY OF THE INVENTION

It is an object of the present invention to provide an improved method for easily adjusting a hearing device as well as an arrangement for adjusting the hearing device.

The foregoing and other objects of the present invention are achieved by a method for adjusting a hearing device to individual needs of a hearing device user, the hearing device comprising an input transducer, a signal processing unit and an output transducer, the signal processing unit being operatively connected to the input transducer as well as to the output transducer, and the signal processing unit defining an input/output behavior of the hearing device, the method comprising the steps of:

- operationally connecting the hearing device to a fitting device comprising a display unit,
- displaying a hearing threshold level of the hearing device user as a function of frequencies on the display unit,
- displaying characteristics of a predefined sound sample on the display unit, and
- adjusting the input/output behavior such that at least a part of the predefined sound sample lies above the hearing threshold level at corresponding frequencies.

In an embodiment of the present invention, at least two of
- the hearing threshold level as a function of frequencies,
- an uncomfortable level,
- the characteristics of the predefined sound sample,
- the predefined sound sample after having adjusted the input/output behavior, are displayed in a single graph on the display unit.

Further embodiments of the present invention comprise the step of coloring representations of the predefined sound sample according to loudness indications.

Further embodiments of the present invention comprise the step of selecting a frequency band, in which the input/output behavior is adjusted.

Further embodiments of the present invention comprise the step of presenting the predefined sound sample after the step of adjusting the input/output behavior.

Further embodiments of the present invention comprise the steps of:
- measuring an output signal of the output transducer, and
- representing the measured output signal on the display unit.

Further embodiments of the present invention comprise the step of indicating directions how to adjust the input/output behavior for a selected predefined sound.

In still further embodiments of the present invention, predefined sound samples comprise frequency sections, which are particularly important for good speech intelligibility.

In still further embodiments of the present invention, predefined sound samples are at least one of the following or a synthetically generated equivalent:
- spoken high “s”;
- spoken low “s”;
- spoken “sch”;
- spoken “f”;
- spoken voiced consonants “m”, “n”, “l”;
- spoken vowels “a”, “e”, “u”.

Furthermore, the present invention is also directed to an arrangement for adjusting a hearing device to individual needs of a hearing device user, the arrangement comprising:
- a fitting device comprising a display unit,
- the hearing device comprising an input transducer, a signal processing unit and an output transducer, the signal processing unit being operatively connected to the input transducer as well as to the output transducer, and the signal processing unit defining an input/output behavior of the hearing device,
- means for operationally connecting the hearing device to the fitting device,
- means for displaying a hearing threshold level of the hearing device user as a function of frequencies on the display unit,
- means for displaying characteristics of a predefined sound sample on the display unit, and
- means for adjusting the input/output behavior such that at least a part of the predefined sound sample lies above the hearing threshold level at corresponding frequencies.

In an embodiment of the inventive arrangement, at least two of
- the hearing threshold level as a function of frequencies,
- an uncomfortable level,
- the characteristics of the predefined sound sample,
- the predefined sound sample after having adjusted the input/output behavior, are displayed in a single graph on the display unit.

Further embodiments of the inventive arrangement comprise means for coloring representations of the predefined sound sample according to loudness indications.

Further embodiments of the inventive arrangement comprise means for selecting a frequency band, in which the input/output behavior is adjusted.

Further embodiments of the inventive arrangement comprise means for presenting the predefined sound sample after the input/output behavior has been adjusted.

Still further embodiments of the inventive arrangement comprise:

means for measuring an output signal of the output transducer, and means for representing the measured output signal on the display unit.

Further embodiments of the inventive arrangement comprise means for indicating directions how to adjust the input/output behavior for a selected predefined sound.

In still further embodiments of the inventive arrangement, predefined sound samples comprise frequency sections, which are particularly important for good speech intelligibility.

In further embodiments of the inventive arrangement, predefined sound samples are at least one of the following or a synthetically generated equivalent:

spoken high "s";
spoken low "s";
spoken "sch";
spoken "f";
spoken voiced consonants "m", "n" "l";
spoken vowels "a", "e", "u".

It is expressly pointed out that also all combinations of the above-mentioned embodiments are possible and herewith disclosed. Only those embodiments or combinations of embodiments are excluded that would result in a contradiction.

BRIEF DESCRIPTION OF THE DRAWINGS

Preferred embodiments of the present invention are hereinafter described by way of example referring to the following drawings.

DETAILED DESCRIPTION OF THE INVENTION

Figure 1:
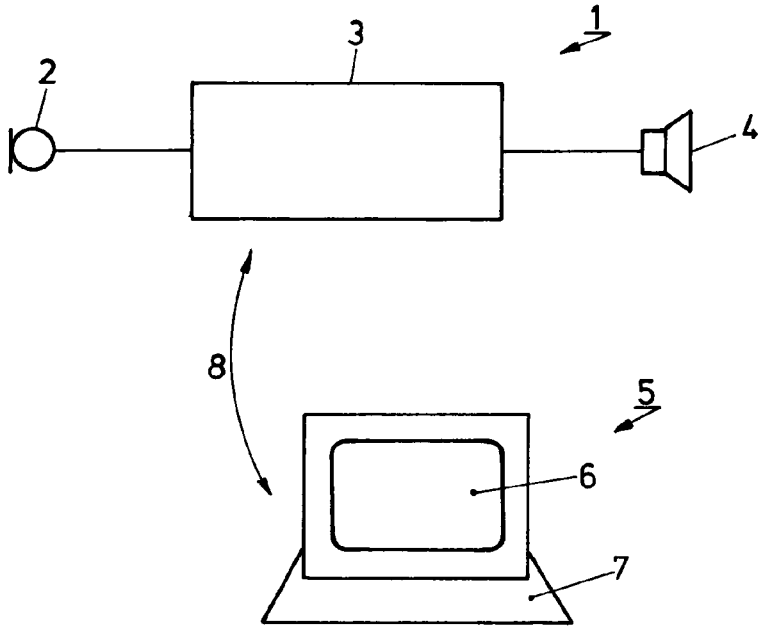
FIG. 1 shows an embodiment of an arrangement according to the present invention comprising a hearing device and a fitting device.

In FIG. 1, an arrangement for adjusting a hearing device 1 is depicted, the hearing device 1 comprising an input transducer 2, e.g. a microphone, a signal processing unit 3 and an output transducer 4. As it is well known in the art, the input transducer 2 picks up sound and converts it into a corresponding electrical signal. The electrical signal is fed to the signal processing unit 3, in which an electrical output signal is generated that is fed to the output transducer 4, in which the electrical signal is converted into a corresponding acoustical signal. It is pointed out that the output transducer 4 may be of any type. The output transducer may be, for example, a loudspeaker (i.e. a receiver) or any other suitable actuator, as it is used, for example, in connection with implantable hearing devices. Of course, an actuator in an implanted hearing device does usually not generate an acoustical signal, but a corresponding signal that stimulates suitable internal structures of the human body.

The signal processing unit 3 is treating the input signal according to a processing scheme that is particularly dictated by the hearing impairment of the hearing device user. The aim of the signal processing unit 3 is to generate an output signal for the output transducer 4 such that the hearing device user can perceive the sound like a normal person that does not have a hearing impairment and therefore does not have to wear a hearing device.

The present invention is directed to adjust the manner how the signal processing unit 3 is processing the input signal, defining the so called input/output behavior of the hearing device 1. Thereto, a fitting device 5 is used comprising a display unit 6 and an input unit 7. Usually, the fitting device 5 is a commercially available personal computer provided with fitting software from the manufacturer of the hearing device 1. The adjustment or fitting is done by an audiologist, for example, who provides, together with the hearing device user, the necessary information for the adjustment. During the adjustment process, the hearing device 1 is usually inserted into the ear of the hearing device user, and the fitting device 5 is operatively connected via a link 8 to the hearing device 1. For example, the link 8 is implemented by using a wire or is implemented wirelessly. However, an offline adjustment, i.e. without the hearing devices user being present in the office of the audiologist, can also be carried out.

Figure 2:
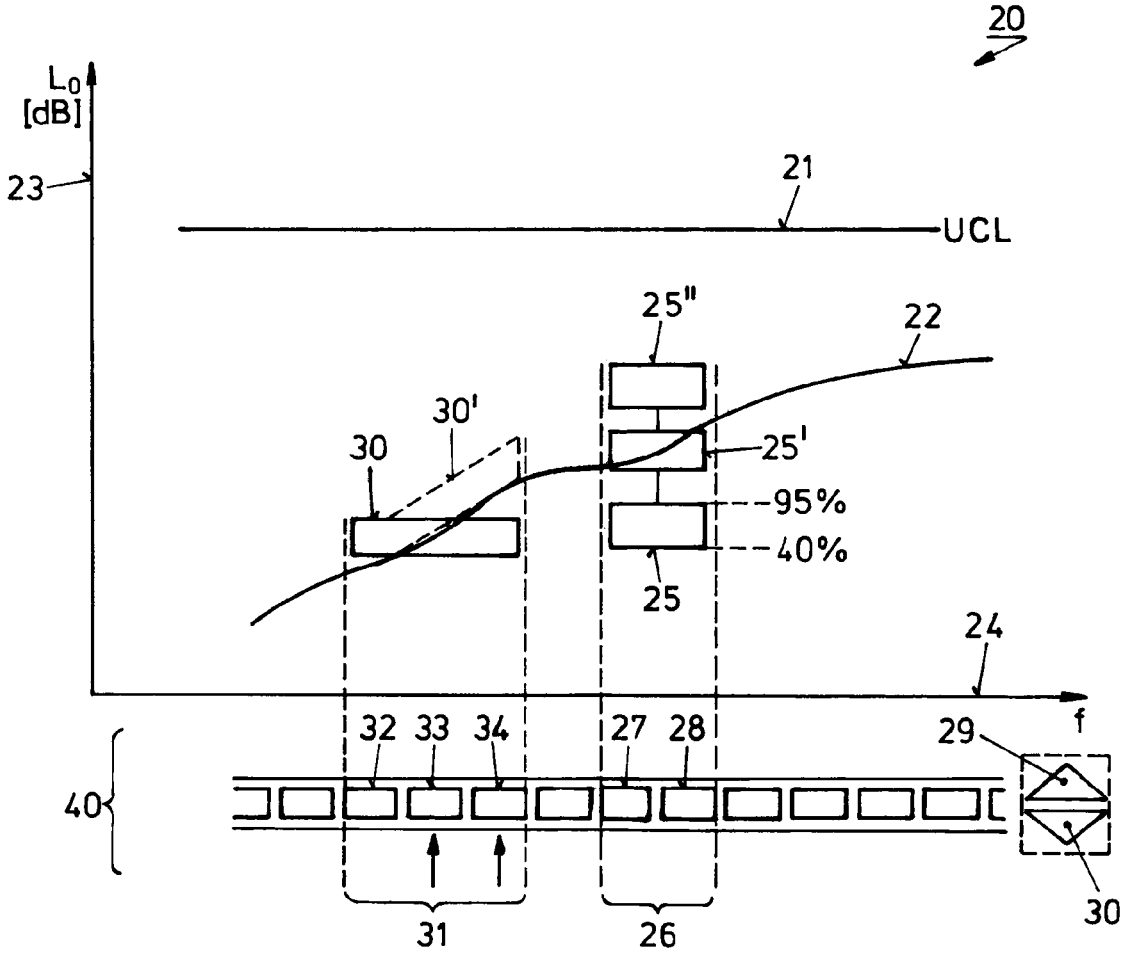
FIG. 2 shows a possible screenshot of a display of the fitting device according to FIG. 1.

In FIG. 2, a screenshot of the display unit 6 (FIG. 1) is depicted. It shows a graphical representation of the output level of the output transducer 4 on the y-axis in decibel (dB) as a function of frequency, which is represented on the x-axis in Hertz (Hz).

In the graph, a hearing threshold level 22 as a function of frequency is shown being derived from an audiogram, for example, established of the hearing device user. The hearing threshold level 22 delimits sound that can be heard, i.e. sound levels above the hearing threshold level 22, and sound that cannot be heard, i.e. sound levels below the hearing threshold level 22. In addition to the hearing threshold level 22, an uncomfortable level 21 (UCL) is indicated in the same graphical representation. The uncomfortable level 21 indicates the level above which the hearing device user is discomforted when confronted with a higher sound level than the uncomfortable level. Therefore, the output sound level of the output transducer 4 (FIG. 1) should lie between the hearing threshold level 22 and the uncomfortable level 21 in order that the hearing device user can clearly hear a sound and is not discomforted by sounds that are too loud. It is the task of the audiologist—or whoever adjusts the hearing device to a particular user—to adjust the input/output behavior such that in particular speech resides in this residual dynamic range—namely the range between the hearing threshold level and the uncomfortable level at a specific frequency.

It has been found out that a few specific sounds are in particular important for good speech intelligibility. Therefore, the adjustment of a hearing device should be such that these sounds lie in the above-mentioned auditory residual dynamic. In addition, these sounds should be distinguishable by the hearing device user. These sounds are referred to as predefined sound samples throughout this specification.

According to the present invention, characteristics of a predefined sound sample 25, 30 are displayed in the same graph (FIG. 2) as the uncomfortable level 21 and the hearing threshold level 22. As can be seen in FIG. 2, the predefined sound sample 25 covers a certain frequency range (bound by dashed lines). Furthermore, the predefined sound sample 25, as it is given out by the output transducer 4 (FIG. 1), lies below the hearing threshold level 22. Therefore, the audiologist immediately recognizes that the predefined sound sample 25 cannot be heard by the hearing device user. In turn, the input/output behavior of the hearing device, e.g. the gain, is adapted so that this predefined sound sample is audible by the hearing device user. By the reference sign 25' and 25", characteristics of the predefined sound sample 25 are indicated resulting from an adapted input/output behavior of the hearing device.

While the predefined sound sample 25' partly lies above the hearing threshold level 22, the predefined sound sample 25" completely lies above the hearing threshold level 22. As a result, the audiologist, while consulting the display unit 6, realizes that hearing is improved with the input/output behavior raising the predefined sound sample as indicated at 25'. At the same time, the audiologist also realizes that the input/output behavior must further be adjusted in order to further improve intelligibility of the particular predefined sound sample. By further adjusting the input/output behavior of the hearing device 1, the predefined sound sample moves to a level as indicated by 25", thus now completely lying in the auditory residual dynamic of the hearing device user.

In order that the input/output behavior of the hearing device 1 is only adjusted in the frequency range in that the predefined sound sample 25 lies, the audiologist may select, in a further embodiment of the present invention, the frequency band or frequency range 26, in which the input/output behavior must be adjusted. The selection can be performed, for example, by pressing corresponding frequency selection buttons 27 and 28 in a frequency selection bar 40 on the display unit 6 with a pointing device, such as a computer mouse (not shown in FIG. 2). To each of the frequency selection buttons of the frequency selection bar 40, a predefined frequency range is assigned.

Another predefined sound sample is indicated by reference signs 30 and 30' in a lower frequency range. Because the predefined sound sample 30 partly lies above the hearing threshold level 22, only a section of a frequency region 31 related to this predefined sound sample 30 is selected. In this example, frequency selection buttons 33 and 34 are activated but not frequency selection button 32. As a result, as indicated at 30', the predefined sound sample now lies completely above the hearing threshold level 22 after the input/output behavior has been adjusted, and the predefined sound sample can therefore be clearly perceived by the hearing device user wearing the adjusted hearing device 1.

The input/output behavior of the hearing device 1 is, in a further embodiment of the present invention, adjustable via adjustment button 29 and 30 allowing increasing or decreasing a gain, for example, in the selected frequency region. For the example with the predefined sound sample 25 depicted in FIG. 2, the frequency selection buttons 27 and 28 are activated before the adjustment button 29 is pressed by a pointing device, for example. Therewith, any adjustment made via the adjustment button 29 is only effective in the selected frequency region 26, and the audiologist can follow the effect of the adjustment on the screen of the display unit 6.

In a still further embodiment of the present invention, the input/output behavior of the hearing device is checked by presenting the actual predefined sound sample 25 or 30 to the hearing device user with inserted hearing device 1. The hearing device user can then give a feedback to the audiologist. In addition, the predefined sound sample, as it is presented to the hearing device user, is measured and displayed on the display unit 6. Therewith, the audiologist is able to objectively check whether the adjustment made to the input/output behavior of the hearing device is correct or whether further adjustments must be made. In addition, the feedback of the hearing device user can give further indication of the quality of the adjustment.

In a still further embodiment of the present invention, directions how to adjust the input/output behavior is indicated to the audiologist. The directions are displayed on the display unit 6 after a predefined sound sample has been selected since the directions are dependent on the selected predefined sound sample. For example, if the audiologist selects a particular predefined sound sample for adjusting the input/output behavior correcting a mild hearing loss, the audiologist will read the following instructions: "Please adjust the signal such that it is just audible by the hearing device user". For a hearing device user having a heavy hearing loss, the same predefined sound sample may not be heard with any adjustment (e.g. because the auditory residual range is too small). In this case, the audiologist will be informed that this predefined sound sample cannot be used to improve the intelligibility.

The characteristics of a predefined sound sample 25, 30 must be such that, for a large number of hearing losses, the number of predefined sound sample 25, 30 is as low as possible in order to obtain a fast adjustment of the input/output behavior and in order to reach a high degree of speech intelligibility. For example, the following predefined sound samples are used:

spoken high "s";
spoken low "s";
spoken "sch";
spoken "f";
spoken voiced consonants "m", "n"
spoken vowels "a", "e", "u".

It is pointed out that other predefined sound samples can be added to further increase the number of sound presentations.

It has been shown that the following sequence of sound presentation is advantageous:

First, the predefined sound sample "spoken high s" is presented for female hearing device users. Accordingly, the sound sample "spoken low s" is presented for male hearing device users.

Second, the predefined sound sample "spoken sch" is presented and the input/output behavior is adjusted such that this sound sample can be differentiated from the first presented sound sample.

The remaining sound samples are presented in the sequences listed above, and the adjustment of the input/output behavior is such that the sound sample can just be heard by the hearing device user.

In a further embodiment of the present invention, the representation of the predefined sound sample in the graph on the display unit 6 according to FIG. 2 is based on the percentile area, whereas, for example, of all sound levels of a specific predefined sound sample, 40% fall below the lower sound level of the area and 5% fall above the area. This is indicated in FIG. 2 for the predefined sound sample 25, where the lower level is marked by 40% and the higher level is marked by 95%.

In a further embodiment of the present invention, the area representing a predefined sound sample is colored according to a loudness scheme, whereas for each loudness level "too loud", "loud", "medium loud", "soft" and "not audible" a different color is used to assist the audiologist that he can immediately recognize the adjustment made to the input/output behavior.

It is further pointed out that the present invention is not only directed to hearing devices that are used to improve the hearing of hearing impaired patients. The present invention can very well be used in connection with any communication device, be it wired or wireless, or in connection with any hearing protection device.

What is claimed is:

1. A method for adjusting a hearing device to individual needs of a hearing device user, the method comprising steps of:

operationally connecting the hearing device to a fitting device comprising a display unit, displaying a hearing threshold level of the hearing device user as a function of frequencies on the display unit, displaying characteristics of a predefined sound sample on the display unit, and adjusting the input/output behavior such that at least a part of the predefined sound sample lies above the hearing threshold level at corresponding frequencies, wherein the hearing device comprises:

an input transducer, an output transducer, and a signal processing unit operatively connected to both the input transducer and to the output transducer, said signal processing unit defining an input/output behavior of the hearing device.

2. The method of claim 1, wherein at least two of the hearing threshold level as a function of frequencies, an uncomfortable level, the characteristics of the predefined sound sample after having adjusted the input/output behavior, are displayed in a single graph on the display unit.

3. The method of claim 1 or 2, further comprising a step of representing the predefined sound sample in colors according to loudness indications.

4. The method of claim 1, further comprising a step of selecting a frequency band, in which the input/output behavior is adjusted.

5. The method of claim 1, further comprising a step of presenting the predefined sound sample after the step of adjusting the input/output behavior.

6. The method of claim 5, further comprising steps of:

measuring an output signal of the output transducer, and representing the measured output signal on the display unit.

7. The method of claim 1, further comprising a step of indicating directions how to adjust the input/output behavior for a selected predefined sound sample.

8. The method of claim 1, wherein predefined sound samples comprise frequency sections, which are particularly important for good speech intelligibility.

9. The method of claim 8, wherein predefined sound samples are at least one of or a synthetically generated equivalent of the following:

spoken high “s”;

spoken low “s”;

spoken “sch”;

spoken “f”;

spoken voiced consonants “m”, “n”, “l”; and spoken vowels “a”, “e”, “u”.

10. An arrangement for adjusting a hearing device to individual needs of a hearing device user, the arrangement comprising:

a fitting device comprising a display unit, the hearing device comprising an input transducer, a signal processing unit and an output transducer, the signal processing unit being operatively connected to the input transducer as well as to the output transducer, and the signal processing unit defining an input/output behavior of the hearing device, means for operationally connecting the hearing device to the fitting device, means for displaying a hearing threshold level of the hearing device user as a function of frequencies on the display unit, means for displaying characteristics of a predefined sound sample on the display unit, and means for adjusting the input/output behavior such that at least a part of the predefined sound sample lies above the hearing threshold level at corresponding frequencies.

11. The arrangement of claim 10, wherein at least two of the hearing threshold level as a function of frequencies, an uncomfortable level, the characteristics of the predefined sound sample, the predefined sound sample after having adjusted the input/output behavior, are displayed in a single graph on the display unit.

12. The arrangement of claim 10 or 11, further comprising means for representing the predefined sound sample in colors according to loudness indications.

13. The arrangement of claim 10, further comprising means for selecting a frequency band, in which the input/output behavior is adjusted.

14. The arrangement of claim 10, further comprising means for presenting the predefined sound sample after the input/output behavior has been adjusted.

15. The arrangement of claim 14, further comprising:

means for measuring an output signal of the output transducer, and means for representing the measured output signal on the display.

16. The arrangement of claim 10, further comprising means for indicating directions how to adjust the input/output behavior for a selected predefined sound.

17. The arrangement of claim 10, wherein predefined sound samples comprise frequency sections, which are particularly important for good speech intelligibility.

18. The arrangement of claim 17, wherein predefined sound samples are at least one of or a synthetically generated equivalent of the following:

spoken high “s”;

spoken low “s”;

spoken “sch”;

spoken “f”;

spoken voiced consonants “m”, “n”, “l”; and spoken vowels “a”, “e”, “u”.

* * * * *

UNITED STATES PATENT AND TRADEMARK OFFICE

CERTIFICATE OF CORRECTION

PATENT NO. : 9,204,226 B2
APPLICATION NO. : 13/820794
DATED : December 1, 2015
INVENTOR(S) : Ullrich Sigwanz It is certified that error appears in the above-identified patent and that said Letters Patent is hereby corrected as shown below:

In the specification, column 6, line 24, please add -- "l" -- after ""m", "n","

Signed and Sealed this
Twenty-ninth Day of March, 2016

Michelle K. Lee

Michelle K. Lee
*Director of the United States Patent and Trademark Office*